US007431269B2

(12) United States Patent
Carlson et al.

(10) Patent No.: US 7,431,269 B2
(45) Date of Patent: Oct. 7, 2008

(54) RING SHEAVE

(75) Inventors: Derek Carlson, West Haven, UT (US); Russ Vance, South Jordan, UT (US); Kenn Dayton, Salt Lake City, UT (US); Brian Mace, West Jordan, UT (US); George Vent, Riverton, UT (US)

(73) Assignee: Wireline Technologies, Inc., Salt Lake City, UT (US)

( * ) Notice: Subject to any disclaimer, the term of this patent is extended or adjusted under 35 U.S.C. 154(b) by 0 days.

(21) Appl. No.: 11/855,916

(22) Filed: Sep. 14, 2007

(65) Prior Publication Data

US 2008/0067482 A1 Mar. 20, 2008

Related U.S. Application Data

(60) Provisional application No. 60/825,650, filed on Sep. 14, 2006.

(51) Int. Cl.
*B66D 3/04* (2006.01)

(52) U.S. Cl. ..... 254/405; 254/409; 254/412; 254/416; 474/199

(58) Field of Classification Search ..... 254/405, 254/406, 408, 409, 411, 412, 416, 417, 902; D8/360; 474/199
See application file for complete search history.

(56) References Cited

U.S. PATENT DOCUMENTS

| | | | | | |
|---|---|---|---|---|---|
| 3,772,928 | A * | 11/1973 | Gobeille | ..... | 474/170 |
| 4,325,537 | A * | 4/1982 | Winter et al. | ..... | 254/405 |
| 4,366,609 | A * | 1/1983 | Speer | ..... | 29/892.3 |
| 4,610,646 | A * | 9/1986 | Walter et al. | ..... | 474/199 |
| 4,640,496 | A * | 2/1987 | Van Hoomissen et al. | ... | 254/415 |
| 5,398,433 | A * | 3/1995 | Dretzka | ..... | 37/399 |
| 5,449,154 | A * | 9/1995 | Lob | ..... | 254/394 |
| 5,462,368 | A * | 10/1995 | Lob | ..... | 384/512 |
| 5,489,254 | A * | 2/1996 | Lob | ..... | 384/454 |
| 5,984,278 | A * | 11/1999 | Hartlmeier | ..... | 254/415 |
| 6,375,163 | B1 * | 4/2002 | Carlson et al. | ..... | 254/134.3 R |
| 6,481,695 | B1 * | 11/2002 | Fuller | ..... | 254/405 |

* cited by examiner

*Primary Examiner*—Emmanuel M Marcelo
(74) *Attorney, Agent, or Firm*—Kirton & McConkie; Evan R. Witt

(57) ABSTRACT

The present invention is a sheave assembly that includes a ring supported by a support assembly instead of a solid sheave wheel supported by a central axle. The support assembly may include a plurality of rollers or a curved shoe. The ring is made of a lubricated plastic material or other similar material. The ring includes a groove for retaining the wireline or cable and an inner surface that is designed to mate with the outer surface support assembly.

25 Claims, 13 Drawing Sheets

RING SHEAVE

CROSS-REFERENCE TO RELATED APPLICATIONS

This application claims the benefit of U.S. Provisional Application No. 60/825,650, filed Sep. 14, 2006, which application is incorporated herein by reference.

BACKGROUND OF THE INVENTION

A sheave, or grooved wheel, is used in many applications which require support of running cables or lines. Sheaves are commonly used in connection with wells, such as gas wells, oil wells, and water wells. Sheaves are also used in cable stringing operations. While much of the following discussion will refer to the oil and gas well industry, it will be appreciated that the invention disclosed herein may be used in a variety of applications that use sheaves.

Wells, such as gas wells, oil wells, and water wells that are created by drilling a deep, narrow hole in the ground and then cementing or otherwise securing a hollow, tubular casing within the hole. The well head is the portion of the casing exposed above the ground surface. A pump or valve is attached to the well head to control the flow of fluid or gas from the well.

It is frequently desired to run various types of tooling down the casing. Such tooling can include cameras, vibrators, explosives, various sound generators, and equipment for cleaning the interior of the casing. To facilitate lowering of the tooling within the casing, a wireline is used. The wireline must be able to withstand the highly corrosive environment that is commonly encountered within conventional gas and oil wells. Furthermore, the wireline must be sufficiently strong to withstand the tensile force placed on the wireline when the tooling is lowered hundreds and even thousands of feet within the casing. In addition, the type of wireline used is also dependent upon the type of tooling used. For example, some toolings require that the wireline carry an electrical current for powering or sending signals back from the tooling.

Due to the above requirements, the wireline can be extremely expensive, even up to several dollars a foot. Most wireline is comprised of stainless steel or other non-corrosive metal. Examples of conventional wireline include coaxial cable, E-line which is an armor cable with one or more conductive lines on the inside, and slick line which is a solid line often made of carbon steel.

During operation, a large continuous spool of wireline is brought to the well site. Although the wireline is relatively flexible, the wireline must be fed into the casing in such a fashion as to avoid kinking the wireline. Kinking can potentially damage or break the wireline. Furthermore, the wireline must facilitate smooth and easy lowering and raising of the tooling within the casing.

In a typical wireline operation, the cable is deployed from a winch cable reel through a first rigging sheave located on the drilling rig floor. This sheave is called the floor sheave, and the line goes upward from it to a second sheave suspended from a block on or near the center of the top of the drilling derrick. This second sheave is called the top sheave, and the line descends from it downwardly into the borehole.

Both the floor sheave and the top sheave include a freely rotatable wheel having a groove formed around the circumference thereof. The groove is configured to receive and retain the wireline. The wireline is drawn around the wheel of the lower sheave and then drawn over the wheel of the top sheave assembly. The wireline is laid within the groove of the wheels to prevent the wireline from sliding off the wheels. The free end of the wireline is attached to the tooling which is then lowered down into the casing. Typical examples of both floor sheaves and top sheaves are sold by the Wireline Technologies, Inc. located in Utah.

One problem associated with sheaves relates to their size. Specifically, most sheaves are generally heavy and difficult to move/transport. A typical sheave having a diameter of 20 inches weighs at least 60 pounds, and a typical sheave having a diameter of 36 inches weighs about 180 pounds. Such weight of the sheaves means that workmen who must carry these sheaves often experience injuries to their backs or other body parts that are caused by carrying this heavy equipment. Likewise, because the sheaves are heavy, workers will often drop or mishandle the sheave during transport. Such mishandling of the sheaves can cause serious and costly damage to the sheave itself, to the workers, and/or to other property.

There are frequent occurrences in which the tooling may accidentally get caught or momentarily stop as it travels down the casing. At these times, slack is produced in the wireline. This slack can cause the wireline to "jump" out of the groove on the wheel of the sheave assembly. Should the tooling then drop, the wireline and sheave assembly can be both badly damaged. On occasion, jumping of the wireline off of the sheave wheel can result in wireline breaking, thereby causing the tooling to freely fall to the bottom of the well. Not only is it extremely expensive to repair broken wireline, but there is extensive down time and expense in fishing the tooling from the bottom of the well. Furthermore, jumping and/or breaking of the wireline creates a hazard to the surrounding workers that are lowering the tooling Accordingly, there is a need in the art for a new type of a sheave that addresses one or more of the above-referenced problems. Specifically, there is a need in the art for a new sheave that is lighter and easier to use and transport. Likewise, there is a need in the art for a sheave that will prevent a user's hands, clothing, limbs, from contacting and/or being injured by the cable. Further, there is a need in the art for a sheave assembly that will prevent the wireline from "jumping" out of the groove on the wheel of the sheave assembly. These and other advantages are disclosed by the present embodiments.

BRIEF SUMMARY OF THE INVENTION

The present invention is designed to address one or more of the above-recited limitations associated with known sheaves and sheave assemblies. The present invention is a new type of sheave assembly for use with cables and wirelines. It may be used to raise/lower a wireline down into a borehole at the drilling site, used in cable stringing operations or in other applications which require sheave assemblies.

The sheave assembly of the present invention comprises a ring with no center axle and is contrasted with conventional sheave assemblies that use a solid (heavy) sheave wheel with a center axle and bearing assembly. This ring is designed such that it may rotate and support a wireline or cable. This ring weighs significantly less than other known sheave assemblies and thus drastically reduces the weight of the sheave assemblies of the present embodiments. The ring will include a groove that receives and retains the wireline or cable. More specifically, the groove is designed such that if the wireline or cable is loaded onto the sheave assembly, the wireline or cable will fit into the groove on the ring.

The ring will generally be supported by a support assembly. The support assembly may include two or more rollers, two or more bearings, or it may include a low friction stationary support shoe.

When rollers are used to support the ring, each of the rollers will generally comprise an axle and an outer surface. The axle will define an axis or rotation for the rollers. The outer surface is positioned along the peripheral edge of the rollers. The outer surface of the rollers will mate with and support an inner surface of the ring. The rollers are, of course, designed such that the outer surface of each of the rollers will rotate about the axle. More specifically, the rollers are designed to rotate as the ring rotates in connection with movement of the wireline or cable.

When bearings are used to support the ring, each bearing will be attached to and supported by a plate. The bearings may be provided in pairs such that two bearings on the adjacent plates are aligned and will support the ring in a manner similar to a single roller, discussed above. However, the bearings do not need to be provided in pairs, but instead may be staggered along the plates. The use of bearings instead of rollers in the sheave assembly provides substantial weight savings because the rollers, axels, and various spacers are eliminated, and the sheave assembly is thinner.

A low friction stationary support shoe may be made of polished aluminum, stainless steel, or other material sufficiently strong and smooth. It may optionally be coated with a low friction coating, such as Teflon or similar coating.

The ring sheave assembly includes means for loading and unloading the wireline or cable. This may be accomplished using a pivoting plate structure, a pivoting gate structure, or other similar structure that allows the loading and unloading of the wireline or cable.

In one version of the pivoting plate embodiment, one of the rollers will function as a pivot roller whereas the remaining rollers will be designated as support rollers. Both the support rollers and the pivot roller are connected to a pivot plate. This plate is positioned generally on the front surface of the ring sheave assembly and is designed to cover both the ring and the rollers. An additional support structure, such as a second plate, will be added to the back of the sheave assembly and will similarly be designed to protect the ring/rollers.

The pivot plate may additionally comprise one or more slots. In general, the slots are grooves in the pivot plate that are designed such that the axle of the support rollers may engage and/or fit into the slots. Generally, these slots will be located on the interior side of the pivot plate. The slots preferably will be grooves on the interior of the pivot plate rather than holes in the pivot plate; however, slots that are holes in the pivot plate may be used.

The sheave assembly may also comprise a latch that is attached to the pivot plate. The latch has an engaged position and a disengaged position. The latch is designed such that when the latch is in the engaged position, the latch prevents the plate from pivoting about the axle of the pivot roller.

Once the latch has been disengaged, the user may pivot the pivot plate about the axle of the pivot roller. As noted above, the axles of the support rollers are designed such that they will engage and/or fit into the slots in the pivot plate. Accordingly, when the pivot plate is pivoted about the pivot axle, the support roller axles will slide within the slots. When the support roller axles reach the end of the slots, the support roller axles will contact the top edge of the slots and will prevent the pivot plate from pivoting "too far."

When the pivot plate is pivoted about the pivot axle, the ring and the groove become exposed to the user. Such "opening" of the sheave assembly allows the user to load the wireline into the groove within the ring. Likewise, this type of opening of the sheave assembly allows the wireline to be readily removed from the sheave assembly when the task is completed.

After the wireline or cable has been loaded onto the groove/ring, the pivot plate may be pivoted back into the "closed" position. At this point, the latch may be placed in the engaged position to hold the pivot plate in the closed position. Once in the closed position, the pivot plate protects the wireline/ring while the ring is rotating and prevents the user from accidentally getting fingers, clothing, body parts, etc. caught on the wireline, the ring, etc.

In another version of the pivoting plate embodiment, two bearings are aligned and share a common axle which functions as a pivot axle. The remaining bearings are independent and unconnected to bearings located on the opposite plate. The pivot plate is pivoted relative to the other plate to expose the ring and enable loading and unloading of a wireline or cable.

In the pivoting gate embodiment, the rollers are secured to front and back plates, which do not pivot in relation to the rollers. Instead, a small pivoting gate is pivotally connected to one plate, such as the front plate. The gate is normally locked in a "closed" position, but may be unlocked and pivoted into an "open" position to allow the wireline to be loaded onto and unloaded from the ring sheave assembly. A pivoting gate embodiment may be used with a sheave assembly utilizing bearings instead of rollers.

BRIEF DESCRIPTION OF THE SEVERAL VIEWS OF THE DRAWINGS

In order that the manner in which the above-recited and other features and advantages of the invention are obtained will be readily understood, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

The presently preferred embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the present invention, as represented in FIGS. 1 through 14 is not intended to limit the scope of the invention, as claimed, but is merely representative of presently preferred embodiments of the invention.

Figure 1:
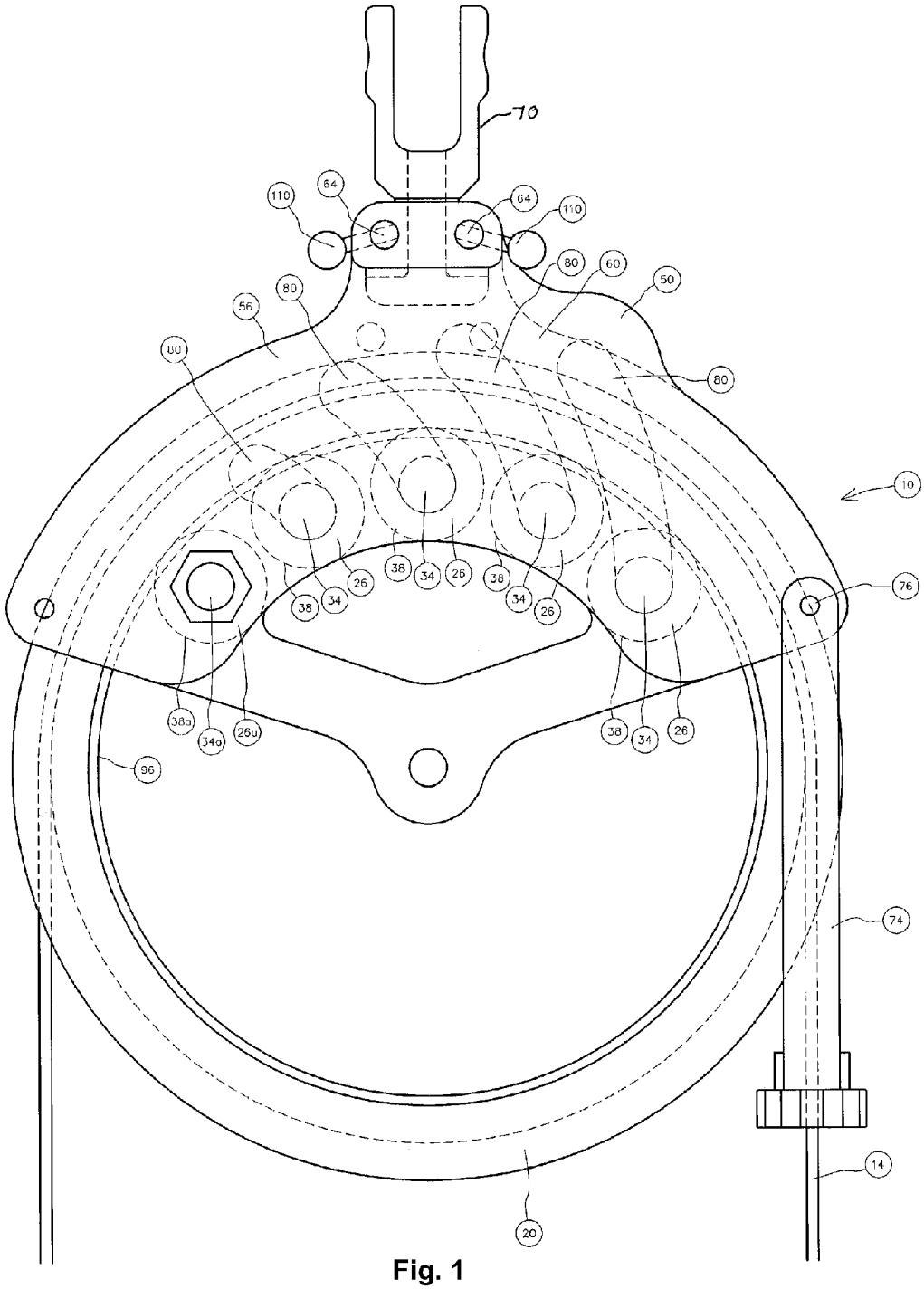
FIG. 1 is a front view of a sheave assembly having a pivoting plate within the scope of the present invention.

FIG. 1 illustrates a front view of a sheave assembly 10 within the scope of the showing a pivoting plate embodiment. The sheave assembly 10 is designed such that it may be used in the oil and gas drilling industry, cable stringing industry, or other application requiring a sheave wheel. More specifically, the sheave assembly 10 is designed such that it may lower a wireline 14 down into a borehole at the drilling site. As will be described in greater detail herein, the sheave assembly 10 has significant advantages over some previously known sheaves. However, for general background on some of the currently known sheaves and sheave assemblies, the reader may consult U.S. Pat. No. 6,105,939, U.S. Pat. No. 5,645,269, U.S. Pat. No. 6,340,271, U.S. Pat. No. 6,375,163 (which patents are expressly incorporated herein by reference).

In commercially available sheaves, the device comprises an integral sheave wheel which is used to move the wireline. However, the present embodiments differ from these previously known sheaves in that they comprise a ring 20 rather than a (heavy) solid, disk-shaped sheave wheel. Like other integral sheave wheels, this ring 20 is designed such that it may rotate and guide a wireline 14 either into or out of a borehole. Yet, the fact that this structure is a ring 20 rather than a solid wheel structure means that the overall sheave assembly 10 may be lighter to use and transport than other previously known sheaves. Such a reduction in weight provides significant advantages in that it will be easier to use/carry and will not cause as many back injuries (and/or other injuries) to workers who must move the sheaves. Further, the fact that the sheave assembly 10 is lighter means that the workers are less likely to mishandle, drop, drag, etc. the sheave assembly 10 during use/transport.

The ring 20 of the present embodiments may be made of various materials, including but not limited to metals, metal alloys, plastics, and plastic composites. In on embodiment, the ring 20 is made of a lubricated plastic. As used herein, the term "lubricated plastic" means any type of durable, self lubricating polymeric material. Because these materials are "self lubricating," these materials will generally have an additive to improve or lower the coefficient of friction. (The coefficient of friction is preferably less than 0.5 and more preferably in the range from 0.15 to 0.35.) Molybdenum disulfide is one useful additive in the polymeric material. Another useful additive is oil.

Further, the class of special high performance plastics, known as engineering plastics, may also be used as the lubricated plastic. Many of these engineering plastics contain nylon as well as other additives to improve properties of the polymeric material, including, but not limited to, glass reinforcement and wax. Suitable engineering plastics may be obtained commercially from a wide variety of suppliers. A few possible suppliers of engineering plastics include Cast Nylons Limited, Willoughby, Ohio; Nylacast, Leicester, England; Polymer Corporation, Rockland, Mass.; and Timco, Peekskill, N.Y.

In some embodiments, the ring 20 may have a sheave diameter of at least sixteen (16) inches. As used herein, the term "sheave diameter" does not refer to the actual diameter of the ring 20. Rather, the term "sheave diameter" refers to the effective diameter of the sheave ring 20 which is the measured distance between the center of the wireline across the diameter of the ring 20.

Those of skill in the art will recognize that there are a variety of different sized sheave assemblies that may have a broad range of sheave diameters. For example, embodiments may be constructed in which the sheave assembly 10 has a sheave diameter of about twenty (20) inches, thirty (36) inches, or other size customarily used in the industry. Other embodiments may be made in which the sheave assembly 10 is very large and has a sheave diameter of about sixty (60) inches or more. Of course, other sizes are also possible. Generally, as is known in the art, these different-sized rings will be constructed using a lathe or other similar machine capable of fabricating the ring. Of course, the constraints and requirements of these types of machines may limit and/or affect the exact sizes of the rings that are available within the scope of the present invention.

The ring 20 will generally be supported by a support assembly. The support assembly may include two or more rollers, two or more bearings, or it may include a low friction stationary support shoe. In the embodiment illustrated in FIG. 1, the ring 20 is supported by two or more rollers 26. These rollers 26 may be made of aluminum, metal, plastic, or other similar materials. In some embodiments, the rollers 26 may be made of a durable lubricated plastic. The rollers may also be made of a low friction material, such as polished metal or metal coated with a low friction coating, such as Teflon. In some embodiments, the rollers may have a diameter of about four (4) inches. Of course, other sizes and/or diameters of rollers may also be used depending on the size of the ring 20 that is supported by the rollers 26.

Each of the rollers 26 will generally comprise an axle 34 and an outer surface 38. The axle 34 will define an axis or rotation for the rollers 26. The outer surface 38 is positioned along the circumferential edge of the rollers 26. The outer surface 38 of the rollers 26 will mate with and support an inner surface 96 of the ring 20. The rollers 26 are, of course, designed such that the outer surface 38 of each of the rollers 26 will rotate about the axle 34. More specifically, the rollers 26 are designed such that they rotate as the ring 20 rotates and as the wireline 14 moves either in or out of the borehole.

The rollers 26 shown in FIG. 1 are positioned in a generally semi-circular configuration. Those of skill in the art will recognize that other arrangements of the rollers 26 are also possible. However, it is worth noting that one of the rollers, roller **26*a* is attached to the sheave assembly 10 in a manner that is different than the other rollers 26. (The attachment and function of this roller 26*a* will be described in greater detail herein). However, for purposes of clarity and illustration, this roller 26*a* will be referred to as the "pivot roller 26*a***."

The rollers 26, 26*a* are connected to a pivot plate 50 that is designed to cover and protect the rollers 26, 26*a*. More specifically, the plate 50 is positioned on the side of the ring 20 and is designed to cover the rollers 26, 26*a*, thereby preventing the user from getting his or her clothing, body parts, etc. caught within the rollers 26, 26*a*. In many embodiments, the plate 50 is made of metal, such as aluminum (including ½ inch thick 7075 aluminum plates), stainless steel (including ½ inch thick 17-4 PH stainless steel). Other types of metals and metal alloys may also be used. Further, those of skill in the art will recognize that, in addition to metal, other types of materials (including plastics, etc.) may also be used to construct the plate 50.

The sheave assembly may additionally comprise a support structure 56 to support the rollers 26. In general, this support structure 56 includes plate 60, made of metal, metal alloy, aluminum, stainless steel, etc. However, other types of structures that are capable of supporting the ring 20 and the rollers 26 may also be used as the support structure 56. The support structure 56 is generally on the side of the ring 20 that is opposite the pivot plate 50.

The pivot plate 50 and the rest of support structure 56 may be attached together through one or more retractable pins 64. The retractable holding pins are designed to hold the plate 50 and the support structure 56 in the proper position during use. However, as the pins 64 are retractable, they (as will be described in greater detail below) may be removed so that the wireline 14 may be loaded onto the sheave assembly 10.

As is known in the art, the sheave assembly 10 may be attached to a clevis 70 that will hold and support the sheave assembly 10 during use. Preferably, as shown in FIG. 1, the clevis 70 is attached to a top portion of the support structure 56.

A hand guard 74 may optionally be attached to the pivot plate 50 via one or more attachment pins 76. Hand guards 74 are known in the art and designed to provide further protection and shielding that will prevent the user's hands, clothing, or body parts from being drawn into the sheave assembly 10. A variety of different types of hand guards 74 are known in the art; however, one of the presently preferred hand guards 74 is the device that is described in U.S. Pat. No. 5,645,269 (which patent is, as noted above, incorporated herein by reference). Accordingly, for more information regarding the hand guard 74, the user should consult this patent. In some embodiments, the hand guard 74 will be attached to the second plate 60 via a ball-lock pin. However, other types of attachment mechanisms and/or means for connecting the hand guard 74 may also be used.

As is shown in FIG. 1, the pivot plate 50 may additionally comprise one or more slots 80. The slots 80 may be grooves in the pivot plate 50 that are designed such that the axle 34 of the support rollers 26 may engaged and/or fit into the slots 80. In some embodiments, the slots 80 will have a generally arcuate shape. However, other shapes and configurations of the slots 80 may also be used. In some embodiments, the slots 80 will only be located on the interior side of the pivot plate 50—i. e., the slots 80 will be grooves partially through the plate 50 rather than slots completely through the plate 50. In some embodiments, these slots 80 will be complete openings in the plate 50 such that the axles 34 will be visible from the outside of the sheave assembly 10. However, if the slots 80 are complete holes in the pivot plate 50, it will be possible that human fingers, body parts, may become caught within these holes. Accordingly, the use of such complete holes in the plate 50 is not presently preferred. Rather, it is presently preferred that the slots 80 are grooves on the interior of the plate 50 such that the slots 80 are shielded/hidden from the exterior side of the sheave assembly 10.

Figure 2:
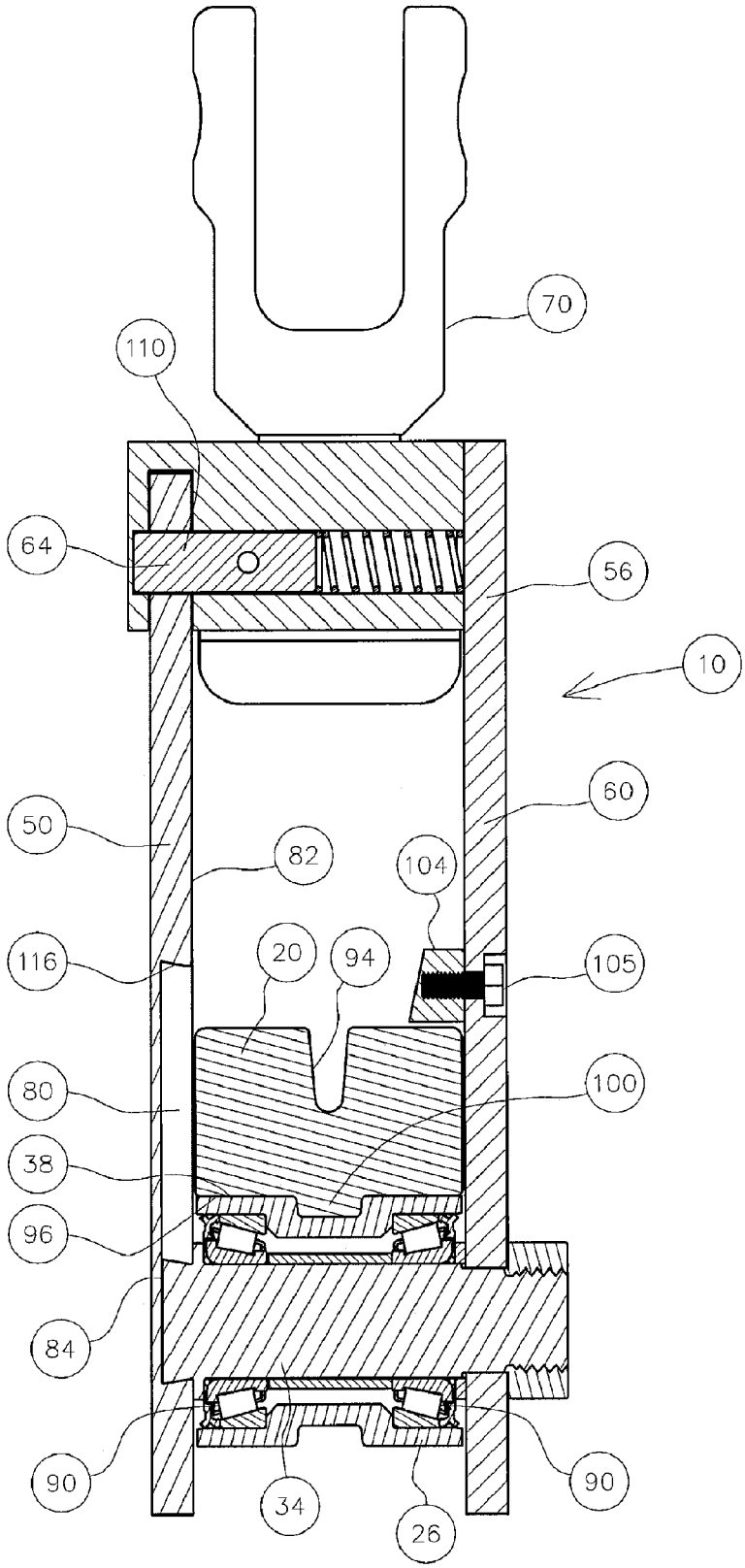
FIG. 2 is a cross-sectional view of the sheave assembly of FIG. 1 which shows the engagement of one of the support rollers with a complementary groove of the sheave ring.

Referring now to FIG. 2, the engagement between the slot 80 and the axle 34 is illustrated in greater detail. FIG. 2 is a cross-sectional view of the sheave assembly 10 taken along one of the support rollers 26. As shown in FIG. 2, the slot 80 is a groove that has been added to the interior surface 82 of the pivot plate 50. A first end 84 of the axle 34 of the roller 26 is designed to fit into this slot 80 and provide engagement between the roller 26 and the pivot plate 50. The engagement between the first end 84 and the axle 34 may be via a dovetail engagement, a T-slot engagement, or other similar engagement.

The engagement between the first end 84 of the axle 34 and the slot 80 may provide significant advantages. For example, this type of engagement will adequately retain and support the plate 50 when the sheave assembly 10 is in use—i.e., when a wireline 14 is added to the ring 20. At the same time, this type of engagement will allow, as will be explained in greater detail below, the pivot plate 50 to pivot and allow access into the ring 20 and the interior of the sheave assembly 10.

As shown in FIG. 2, the axle 34 may also be attached to the support member 56. One or more bearings 90 may also be used in connection with the roller 26. The bearings 90 are usually ball or roller bearings that are designed to reduce the friction associated with the rotation of the roller 26. Because of their higher dynamic capacities, tapered roller bearings and spherical roller bearings will generally be used. Specifically, tapered bearings having sizes of 30×72×28.75 or 35×75×28 as well as spherical bearings having a size of 35×73×23 may be used and/or preferred.

In some embodiments, the positioning of the bearings 90 that is shown in FIG. 2 is desired. However, those of skill in the art will recognize that other configurations, positions, and/or arrangements of the bearings 90 may also be used.

Referring still to FIG. 2, the ring 20 of the present embodiments is illustrated in greater detail. As can be seen in FIG. 2, the ring 20 includes a groove 94 that receives and retains the wireline 14. More specifically, the groove 94 is designed such that if the wireline 14 is loaded onto the sheave assembly 10, the wireline 14 will fit into the groove 94 on the ring 20.

FIG. 2 also illustrates the way in which the ring 20 is supported by the rollers 26. The ring 20 is designed such that it will engage the outer surface 38 of the roller 26. In general, this is accomplished by having the ring 20 comprise an inner surface 96 that will mate with the outer surface 38 of the roller 26. In some embodiments, this type of mating connection is accomplished by having a portion of the inner surface 96 comprises an extending tongue that protrudes into a groove 100 in the outer surface 38 of the roller 26. Of course, other types of mating connections between the inner surface 96 and the outer surface 38 of the roller 26 may also be used.

A retaining pin or bar 104 may also be added to the sheave assembly 10. The retaining pin 104 is positioned above the ring 20. The retaining pin 104 may be secured in position by an attachment device 105, such as a screw or bolt, which passes through the securing member 56. The retaining pin 104 may contact a top portion of the ring 20 to secure/hold the ring 20 on the rollers 26. Of course, if the pin 104 is removed, the ring 20 may be separated from the rollers 26 so that any necessary maintenance to the rollers 26 and/or the axle 34 may be performed.

Figure 3:
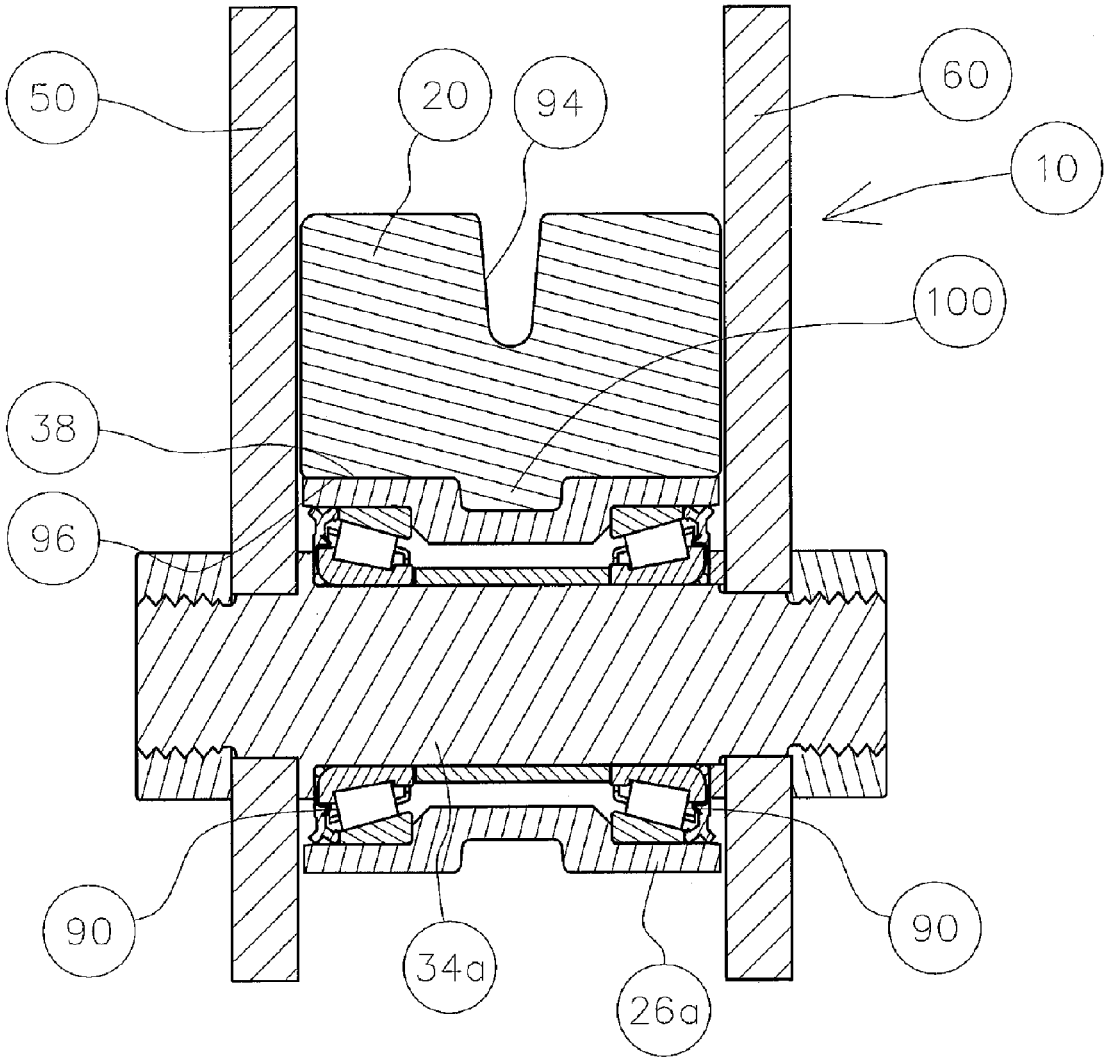
FIG. 3 is a cross-sectional view of the sheave assembly of FIG. 1 which shows the engagement of the pivot roller.

Referring now to FIG. 3, a cross-sectional view illustrates the way in which the pivot roller 26*a* engages the pivot plate 50. FIG. 3 is a cross-sectional view that is similar to the cross-sectional view shown in FIG. 2. However, FIG. 3 differs from FIG. 2 in that FIG. 3 is a cross-sectional view that shows the pivot roller 26*a* (rather than a roller 26).

As shown in FIG. 3, one difference between the pivot roller 26*a* and the support rollers 26 is found in the attachment of the pivot axle 34*a* to the pivot plate 50. More specifically, unlike the roller 26 (shown in FIG. 2), the axle 34*a* does not engage and/or fit into a slot 80 in the pivot plate 50. Rather, the axle 34*a* is connected/attached to the pivot plate 50. However, as will be explained below, this connection between the axle 34*a* and the pivot plate 50 is a "pivoting" attachment in that the axle 34*a* of the pivot roller functions as a pivot such that the pivot plate 50 may pivot about the axle 34*a* of the pivot roller 26*a*.

Figure 4:
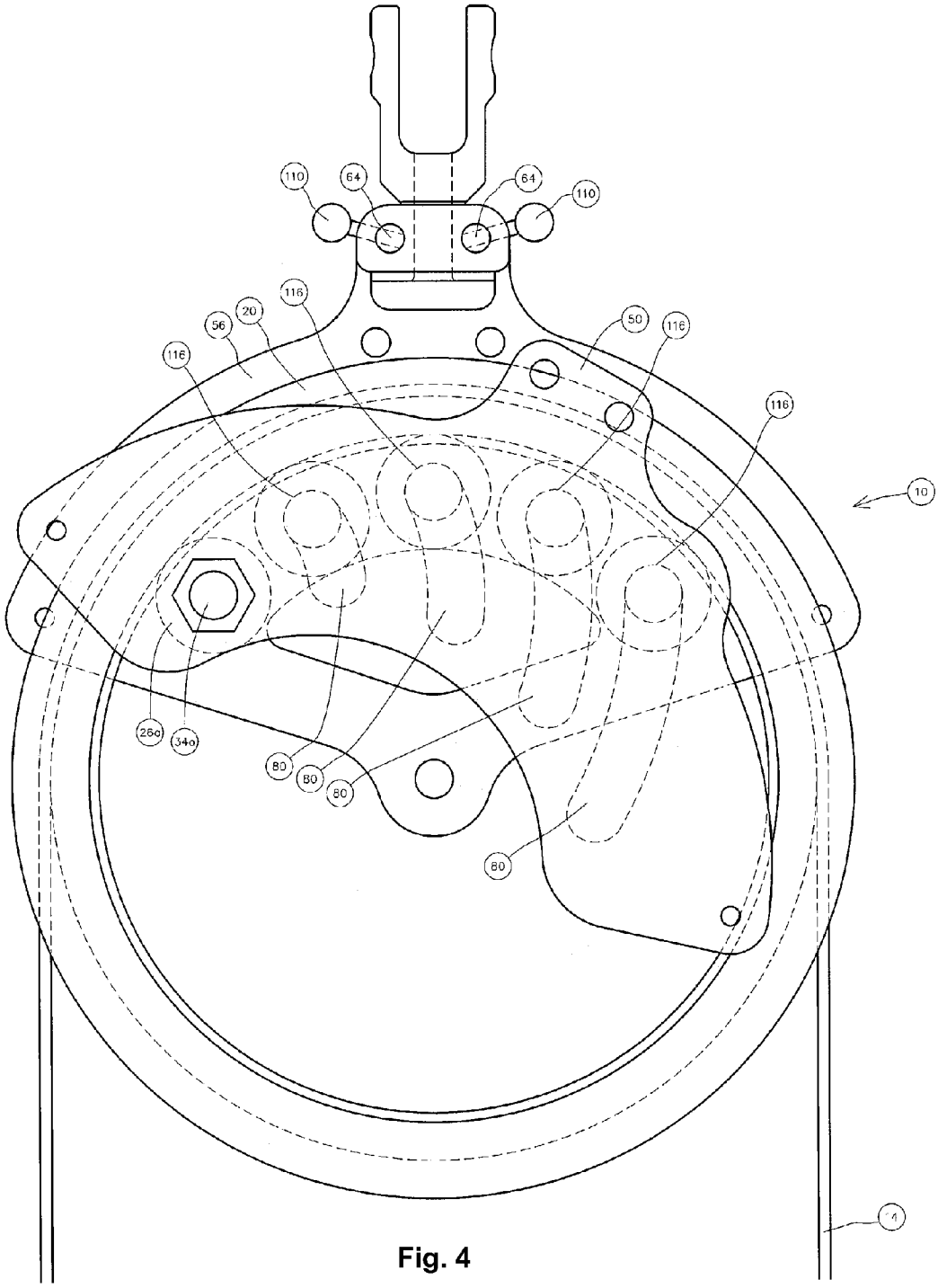
FIG. 4 is a front view that shows the sheave assembly in an open position that allows a wireline to be loaded upon the sheave assembly.

Referring now to FIG. 4, a front view of the sheave assembly 10 is illustrated. As shown in FIG. 4, the sheave assembly 10 may comprise a latch 110 that is attached to the support member 56. The latch 110 has an engaged position and a disengaged position. The latch 110 is designed such that when the latch 110 is in the engaged position, the latch prevents the pivot plate 50 from pivoting about the axle 34*a* of the pivot roller 26*a*. However, as shown in FIG. 4, the latch 110 is in the disengaged position.

Once the latch 110 has been disengaged, the user may pivot the pivot plate 50 about the axle 34*a* of the pivot roller 26*a*. As noted above, the axles 34 of the support rollers 26 are designed such that they will engage and/or fit into the slots 80 in the pivot plate 50 (as illustrated in FIGS. 1 and 2). Accordingly, when the pivot plate 50 is pivoted about the axle 34*a*, the axles 34 will slide within the slots 80. When the axles 34 reach the end of the slots 80, the axles 34 will contact the top edge 116 of the slots 80 and will prevent the pivot plate 50 from any further pivoting. Thus, in this manner, the slots 80 provide an automatic "stop" that prevents the pivot plate 50 from being pivoted "too far."

Further, as shown in FIG. 4, when the pivot plate 50 is pivoted about the axle 34*a*, the ring 20 and the groove 94 become exposed to the user. Such "opening" of the sheave assembly 10 allows the user to load the wireline 14 into the groove 94 so that the wireline 14 may then be lowered into the borehole. Likewise, this type of opening of the sheave assembly 10 allows the wireline 14 to be readily removed from the ring 20 when the task is completed.

It should be noted that in the embodiment shown in FIG. 1, the pivot roller 26*a* is one of the end (i.e. outboard) rollers that are in the sheave assembly 10. Such a configuration is one of the presently preferred embodiments in that such positioning allows the greatest access to the ring 20 when the pivot plate 50 is pivoted.

FIG. 1 illustrates the sheave assembly 10 system after the pivot plate 50 has been pivoted back into the "closed" position. More specifically, once the wireline 14 has been loaded onto the groove 94, the pivot plate 50 may be pivoted back into the closed position. At this point, the latch 110 may be placed in the engaged position to hold the pivot plate 50 in the closed position. As shown in FIG. 1, once the sheave assembly 10 is in the closed position, the pivot plate 50 protects the wireline 14/ring 20 while the ring 20 is rotating and prevents the user from accidentally getting fingers, clothing, body parts, etc. caught on the wireline 14, the ring 20, etc.

It should also be noted that, during use of the sheave assembly 10, the fact that the sheave assembly 10 of the present invention has multiple rollers 26, 26*a* may provide significant advantages. Specifically, one of the known problems associated with currently designed sheaves is that they comprise one large wheel that rotates on a single axle. This large wheel is used to support the wireline or cable. However, if this single axle fails (or is otherwise damaged) during use, there is no longer any structure that supports the sheave wheel. Rather, in this situation, the sheave wheel will not be able to rotate properly even though wireline or cable continues to move across the wheel. Significant damage to a wireline may occur. The wireline may even break causing the wireline and the attached equipment to plummet to the bottom of the borehole.

However, the sheave assembly 10 having multiple rollers 26, 26*a* and multiple axles 34, 34*a* remedies this problem. In essence, this use of multiple rollers/axles introduces "redundancy" into the sheave assembly 10. Accordingly, if one or more of the rollers 26, 26*a* and/or axles 34, 34*a* fail during use, there are still other rollers 26, 26*a* (and/or axles 34, 34*a*) that will support the sheave wheel and will prevent the wireline 14 from being damaged or broken.

Figure 5:
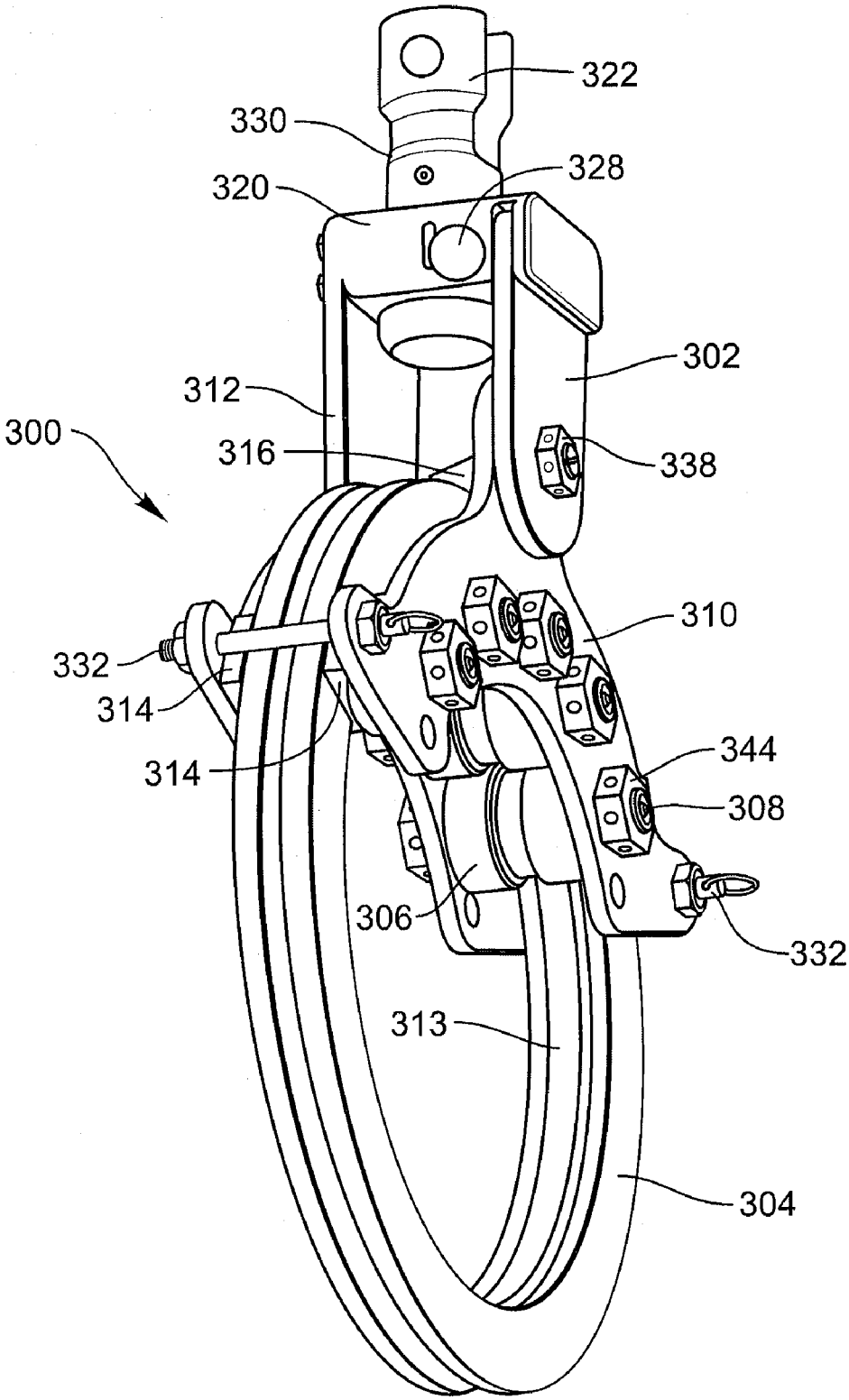
FIG. 5 is a perspective view of a sheave assembly having a pivoting gate within the scope of the present invention in which the gate is in a "closed" position.
Figure 6:
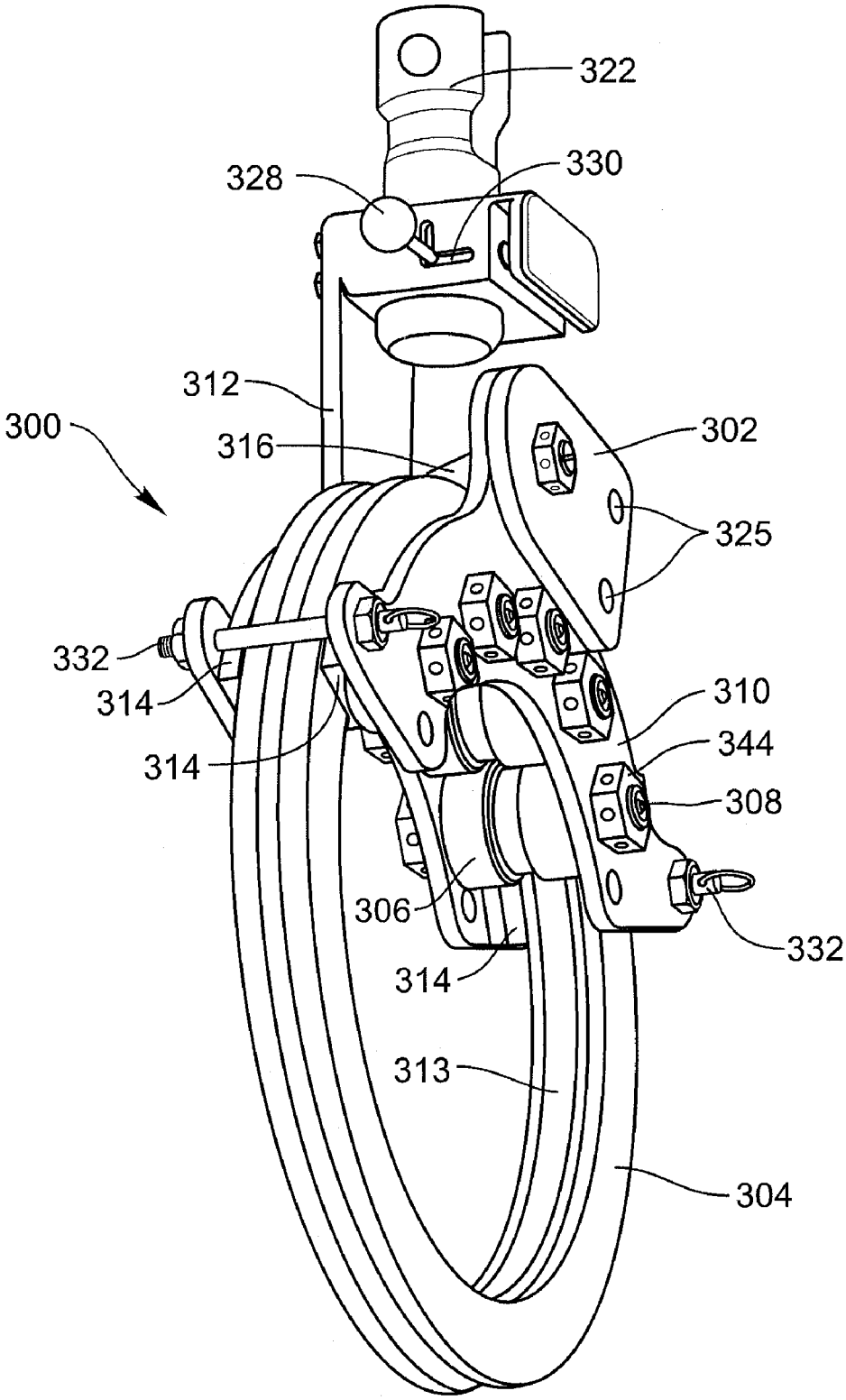
FIG. 6 is a perspective view of the sheave assembly of FIG. 5 which shows the pivoting gate in an "open" position.
Figure 7:
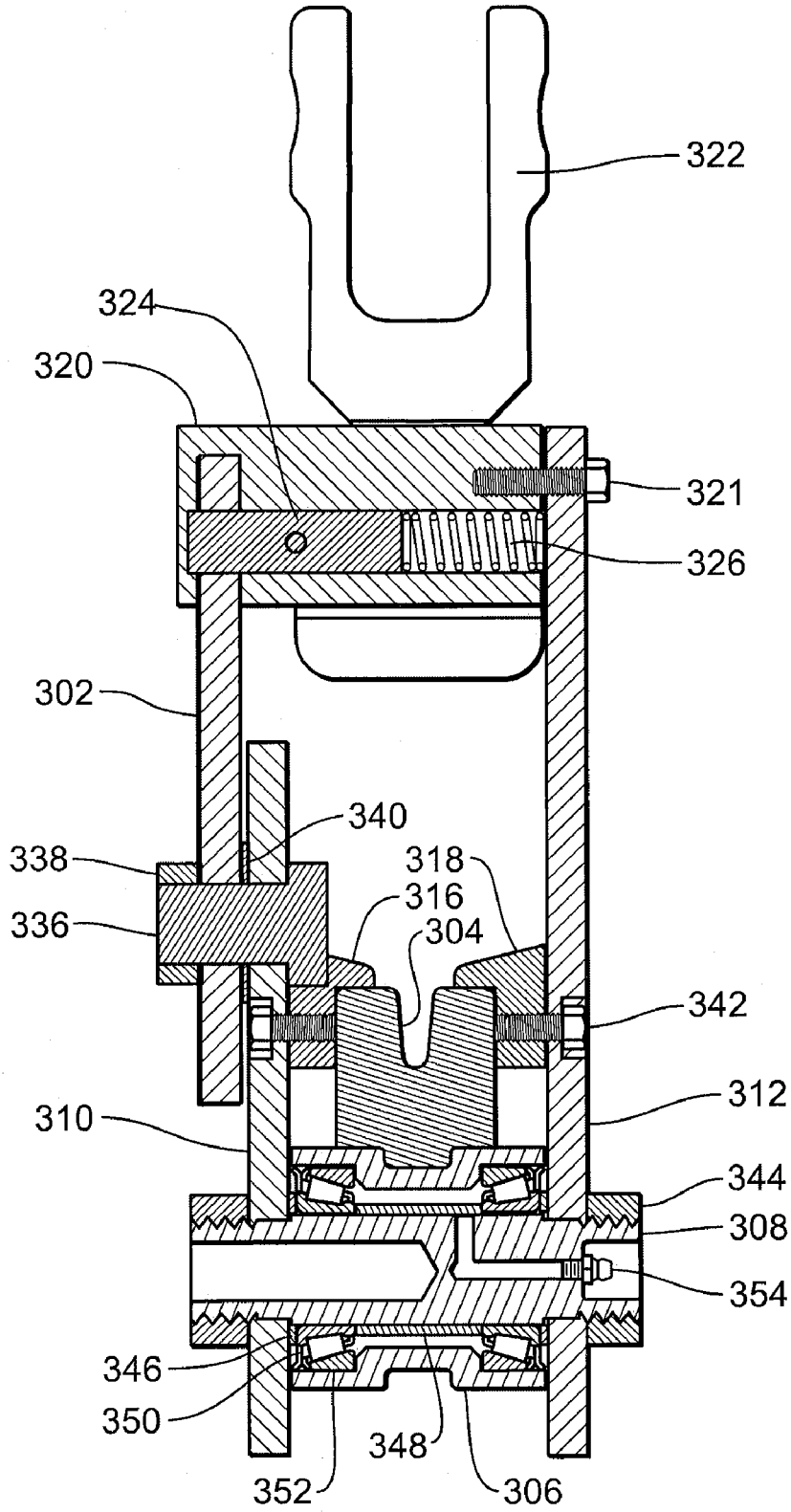
FIG. 7 is a cross-sectional view of the sheave assembly of FIG. 5 showing the pivoting gate.

An alternative embodiment having a pivoting gate mechanism for loading and unloading the wireline is shown in FIGS. 5-7. This embodiment is similar in many respects to the embodiment discussed above. A description of the common features and advantages will not be repeated. Some of the details described below may apply to the embodiment of FIGS. 1-4.

FIG. 5 is a perspective view of a sheave assembly 300 having a pivoting gate 302 within the scope of the present invention in which the gate is in a "closed" position. The sheave assembly includes a ring 304 made of a lubricated plastic material, such as described above. The ring 304 may include reinforcing fillers, such as fiber glass, to improve the strength and durability. The ring 304 is supported by a plurality of rollers 306 each having an axel 308 supported by a front plate 310 and a rear plate 312. As described above, the outer surface of the rollers 306 may be sized and configured to mate with and support an inner surface 313 of the ring 304.

The ring 304 shown in FIGS. 5-7, is narrower than the ring 20 shown in FIGS. 2 and 3. To help maintain proper spacing and alignment of the ring 304, a plurality of pads 314 are secured to the inner surfaces of the front plate 310 and rear plate 312. Pads 314 are preferably fabricated of low friction material, such as metal or a durable plastic material different than the material used to fabricate the ring 304. For example, the pads 314 may be fabricated of ultra high molecular weight plastic. To further help keep the ring 304 properly positioned within the sheave assembly 300, shrouds 316 may be secured to the front plate 310 and rear plate 312. Shrouds 316 may be fabricated of the same material as the pads 314. In one embodiment, the shrouds are fabricated of anodized aluminum. The shrouds 316 are secured near the top of the sheave assembly 300. The shrouds 316 serve the additional function of helping to keep the wireline properly positioned within the ring 304. During operation of the sheave assembly 300, there may be moments where the wireline goes slack and can come out of the groove within ring 304. The shrouds 316 have an upper surface 318 which is angled downward toward the ring 304 to funnel the wireline into the groove within ring 304. This feature is shown best in FIG. 7.

A block 320 is secured to the rear plate 312 via a block fastener 321. A clevis 322 is connected to block 320 to hold and support the sheave assembly 300 during use. One or more locking pins 324, shown in FIG. 7, engage holes 325 in the pivoting gate 302 to lock the gate 302 into the "closed" position, shown in FIG. 5. One or more springs 326 bias the locking pins 324 in position to engage the gate 302. The locking pins 324 are coupled to a ball knob 328 which allows the user to control movement of the locking pins 324, whether to engage and lock the gate 302 or to disengage and unlock the gate 302. The ball knob 328 follows an "L" shaped channel 330 in block 320. FIG. 6 shows the ball knob 328 positioned so that the locking pins 324 disengage and unlock the gate 302. As shown in FIG. 6, the gate 302 is pivoted downward to allow a wireline to be loaded or unloaded from the sheave assembly 300. FIG. 6 shows gate 302 in an "open" position.

Quick release pins 332 engage the front plate 310 and rear plate 312 to help retain the wireline properly positioned within the ring 304. The quick release pins 332 are easily removed and installed to allow loading and unloading of the wireline.

FIG. 7 is a cross-sectional view of sheave assembly of FIG. 5 showing the pivoting gate embodiment. Many of the structures discussed above are shown in FIG. 7. In addition, many internal features are shown. The pivoting gate 302 pivots about pivot 336 which is secured with pivot nut 338. A washer 340 separates the pivoting gate 302 from the front plate 310. The shrouds 316 are attached to the front plate 310 and rear plate 312 with screws 342.

As shown in FIG. 7, the axle 308 is secured in position with axle nuts 344. The bearing assembly for the roller 306 includes side spacers 346 and center spacer 348. A bearing inner race 350 is disposed between the side spacers 346 and center spacer 348. A bearing outer race 352 is positioned to engage the bearing inner race 350. The roller bearing assembly may be lubricated via a grease fitting 354.

An alternative embodiment having a pivoting gate mechanism for loading and unloading the wireline is shown in FIGS. 8-11. This embodiment is similar in many respects to the embodiment discussed above. A description of the common features and advantages will not be repeated. Some of the details described below may apply to the foregoing embodiments shown in FIGS. 1-7.

Figure 8:
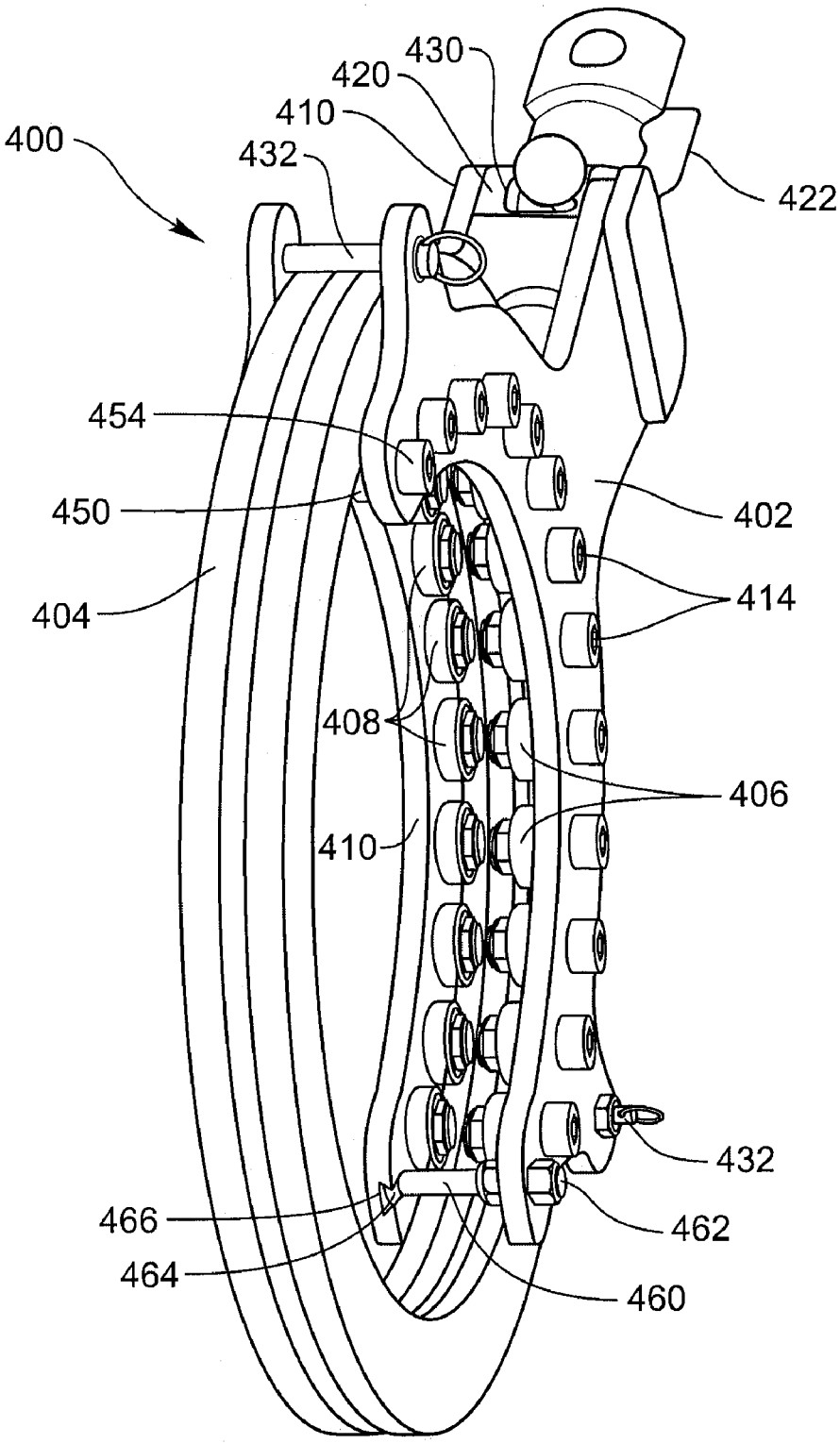
FIG. 8 is a perspective view of another sheave assembly having a pivoting gate within the scope of the present invention in which the gate is in a "closed" position.

FIG. 8 is a perspective view of a sheave assembly 400 having a pivoting plate 402 within the scope of the present invention in which the pivoting plate 402 is in a "closed" position. The sheave assembly includes a ring 404 made of a lubricated plastic material, such as described above. The ring 404 may include reinforcing fillers, such as fiber glass, to improve the strength and durability. The ring 404 is supported by a plurality of bearings 406, 408. The bearings 406 are attached to the pivoting plate 402, and the bearings 408 are attached to a rear plate 410. A plurality of bearing supports 412, 414 are used to support the bearings 408, 406 to their respective plate. In contrast to the embodiments described above which use a plurality of rollers to support the ring, the embodiment shown in FIGS. 8-14 uses a plurality of bearings to support the ring. The bearings 406, 408 may be sized and configured to mate with and support an inner surface of the ring 404.

The ring 404 shown in FIGS. 8-14, is narrower than the ring 20 shown in FIGS. 2 and 3. To help keep the ring 404 properly positioned within the sheave assembly 400, a shroud 416 may be secured to the rear plate 410 with a shroud fastener 418. This feature is shown best in FIG. 10. Shroud 416 may be fabricated of a low friction material, such as metal or a durable plastic material different than the material used to fabricate the ring 404. For example, the shroud 416 may be fabricated of ultra high molecular weight plastic. In one embodiment, the shroud is fabricated of anodized aluminum. The shroud 416 is secured near the top of the sheave assembly 400 with screw 418. The shroud 416 serves the additional function of helping to keep the wireline or cable properly positioned within the ring 404. During operation of the sheave assembly 400, there may be moments where the wireline or cable goes slack and can come out of the groove within ring 404. The shroud 416 has a surface which is angled downward toward the ring 404 to funnel the wireline into the groove within ring 404.

Figure 9:
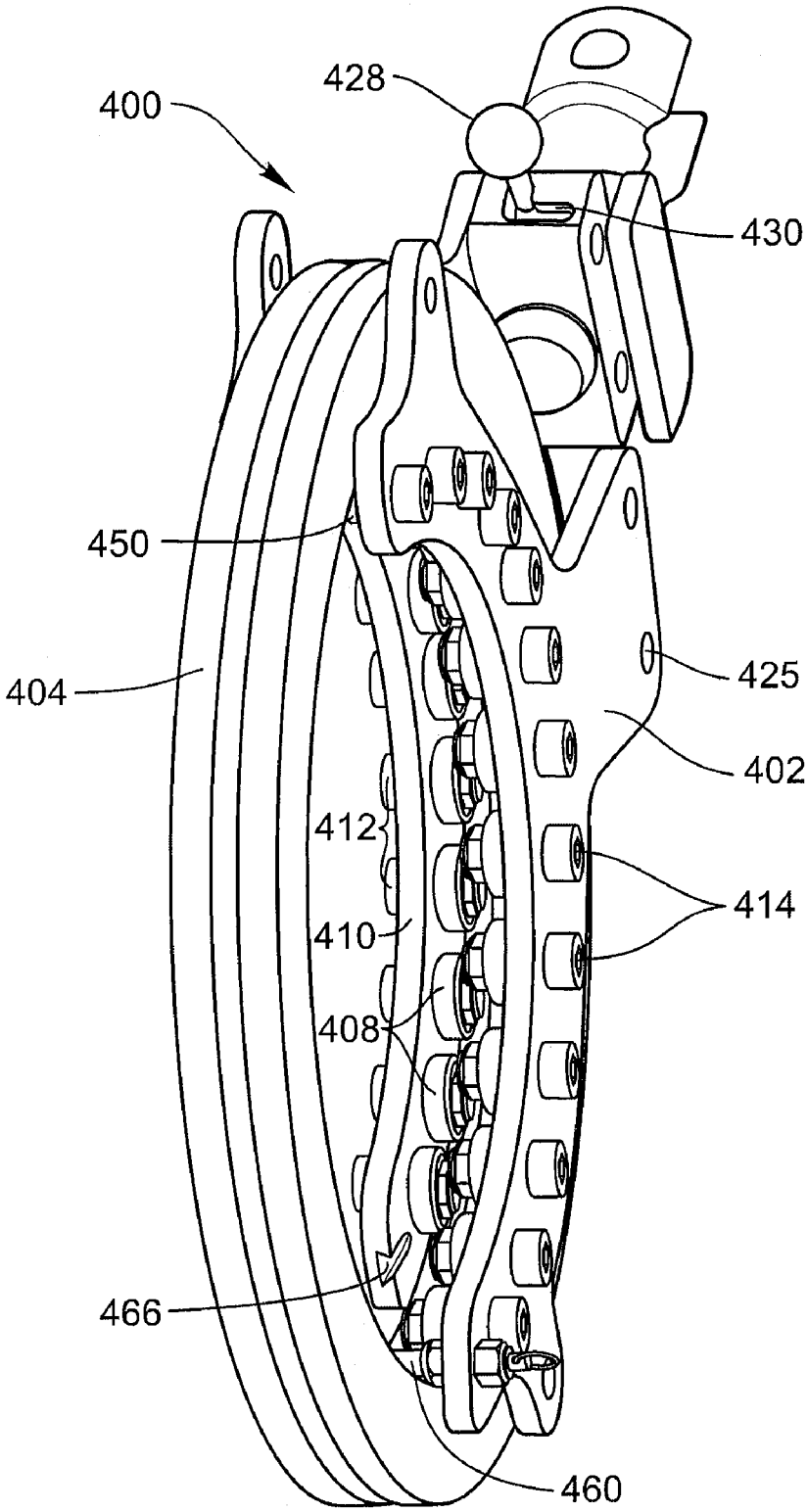
FIG. 9 is a perspective view of the sheave assembly of FIG. 8 which shows the pivoting gate in an "open" position.
Figure 12:
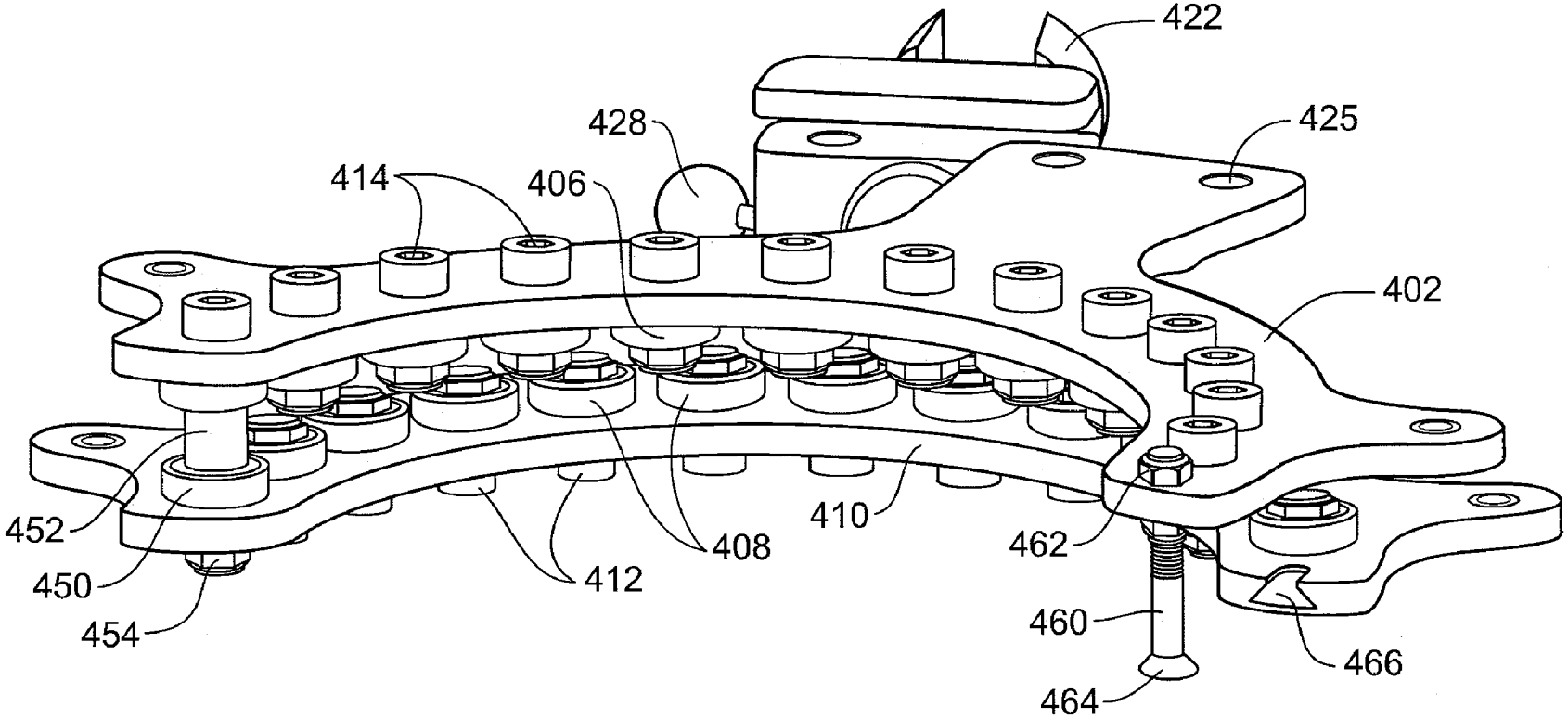
FIG. 12 is a perspective view of the sheave assembly of FIG. 9 with the ring removed to better visualize the pivoting gate in an "open" position.
Figure 13:
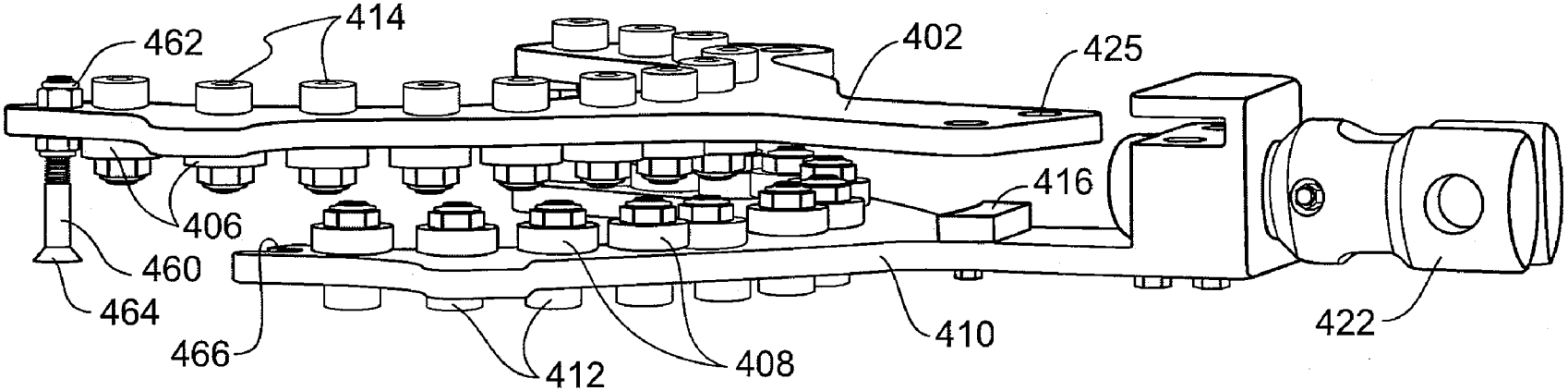
FIG. 13 is another perspective view of the sheave assembly of FIG. 9 with the ring removed to better visualize the pivoting gate in an "open" position.

A block 420 is secured to the rear plate 410 with a block fastener 421. A clevis 422 is connected to block 420 to hold and support the sheave assembly 400 during use. One or more locking pins 424, shown in FIG. 10, engage holes 425 in the pivoting plate 402, shown in FIG. 9, to lock the plate 402 into the "closed" position, as shown in FIG. 8. One or more springs 426 bias the locking pins 424 in position to engage the pivoting plate 402. The locking pins 424 are preferably coupled to a ball knob 428 which allows the user to control movement of the locking pins 424, whether to engage and lock the plate 402 or to disengage and unlock the gate 402. The ball knob 428 may follow an "L" shaped channel 430 in block 420. FIG. 9 shows the ball knob 428 positioned so that the locking pins 424 disengage and unlock the plate 402. As shown in FIG. 9, the pivoting plate 402 is pivoted downward to allow a wireline to be loaded or unloaded from the sheave assembly 400. FIGS. 9, 12, and 13 show plate 402 in an "open" position.

Quick release pins 432 engage the pivoting plate 402 and rear plate 410 to help retain the wireline or cable properly positioned within the ring 404. The quick release pins 432 are easily removed and installed to allow loading and unloading of the wireline or cable.

Figure 10:
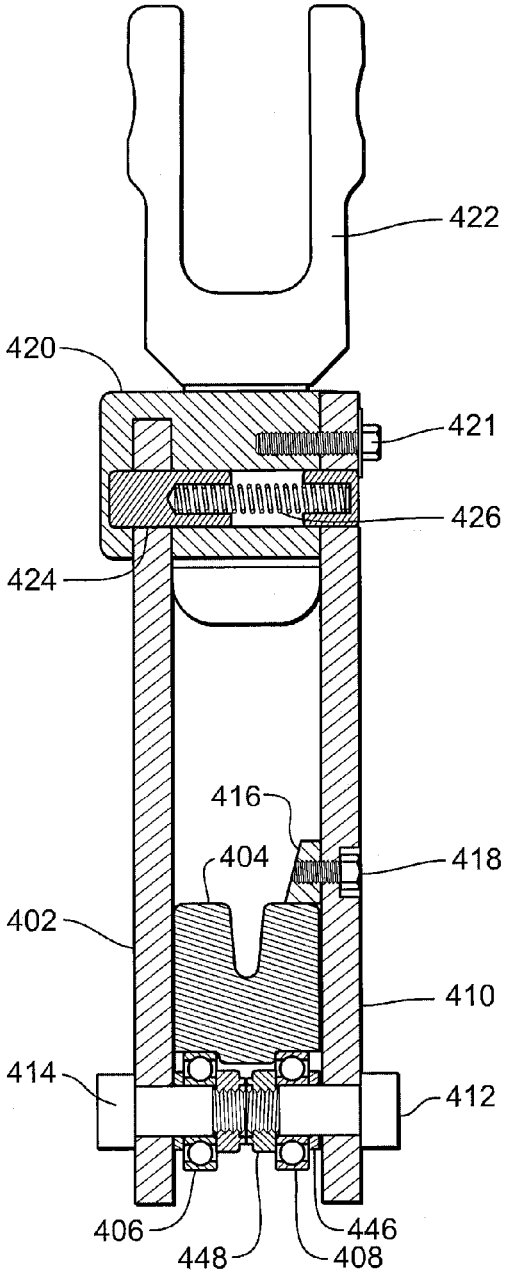
FIG. 10 is a cross-sectional view of the sheave assembly of FIG. 8.
Figure 11:
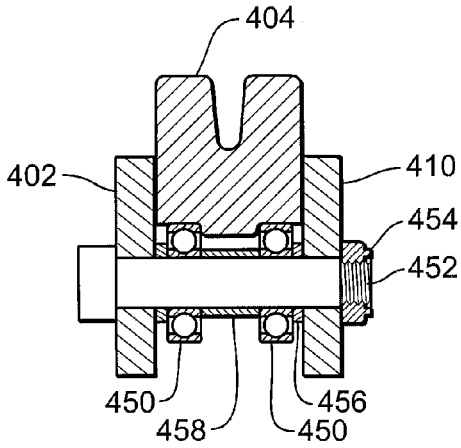
FIG. 11 is another cross-sectional view of the sheave assembly of FIG. 8 showing the pivot axle.

FIG. 10 is a cross-sectional view of sheave assembly of FIG. 8 showing the locking feature of the pivoting plate embodiment. Many of the structures discussed above are shown in FIG. 10. In addition, some internal features are shown. Each bearing 406, 408 is maintained in proper spacing and alignment by a respective side spacer 446 and center spacer 448.

As shown in FIG. 10, the bearings 406, 408 do not share a common axle. The bearings 406 connected to the pivot plate 402 may move out of axial alignment with bearings 408 connected to the back plate 410. This is possible because one pair of pivot bearings 450 share a pivot axle 452, shown in FIG. 11. The pivoting plate 402 pivots about pivot axle 452 which is secured with pivot axle nut 454. The pivot bearings 450 are maintained in proper spacing and alignment by a respective side spacer 456 and center spacer 458.

The bearings 406, 408, 450 are positioned in a generally semi-circular configuration on plates 402, 410. The pivot axle 452 is disposed at one end of the semi-circle, and a locking post 460 is disposed at an opposite end of the semi-circle. The locking post 460 is secured to the pivoting plate with locking post nut 462. The locking post nut 462 has a first end 464 which is sized and configured to engage a slot 466 formed in the rear plate 410. The engagement between the first end 464 and the slot 466 may be via a dovetail engagement, a T-slot engagement, or other similar engagement. This engagement will adequately retain and pivoting plate 402 and the rear plate 410 in proper spacing and alignment when the sheave assembly 400 is in use—i.e., when a wireline or cable is added to the ring 404. At the same time, this type of engagement will allow the pivoting plate 402 to pivot and allow access into the ring 404 and the interior of the sheave assembly 400, in a manner similar to the embodiment described above in FIGS. 1-4.

Figure 14:
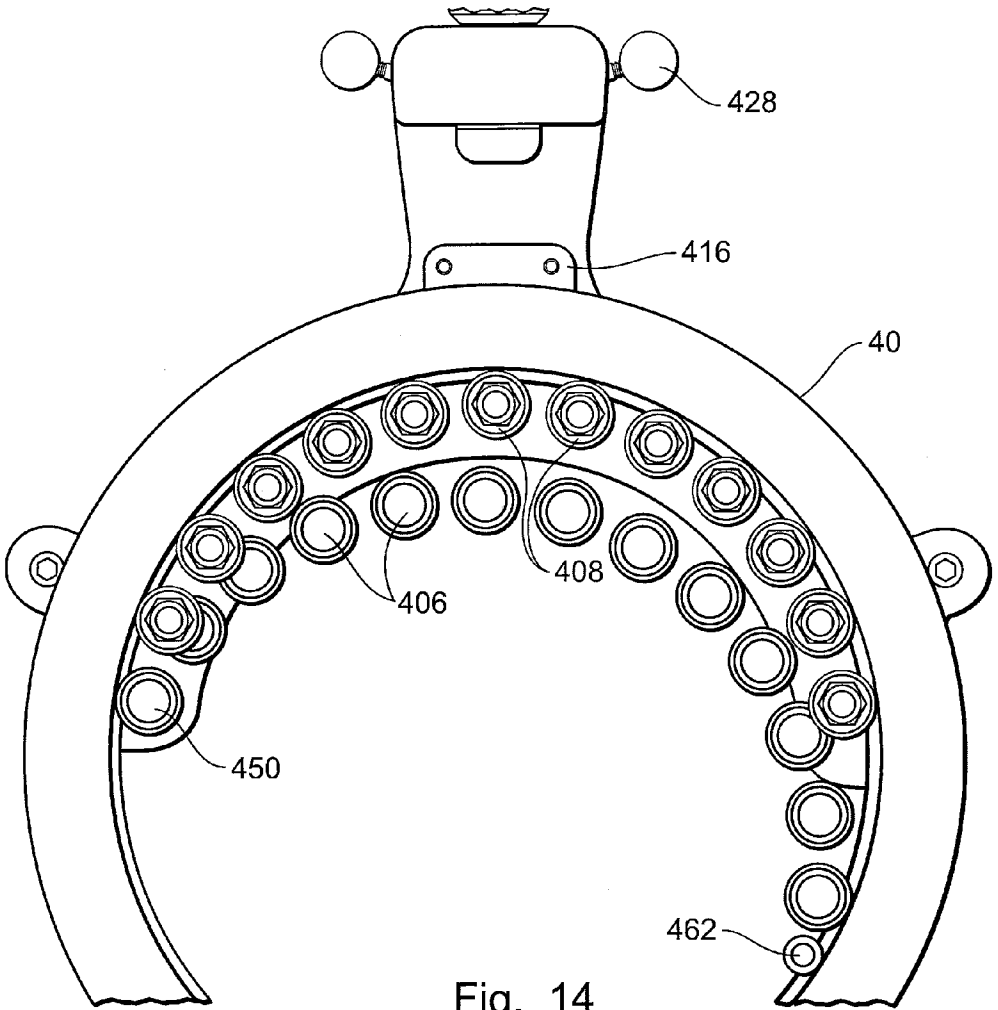
FIG. 14 is a front view of the sheave assembly of FIG. 9 with the pivoting plate removed to better visualize the relative position of the bearings in an "open" position.

In practice, once a user disengages the locking pins 424 from holes 425 in the pivoting plate 402 and removes the quick release pins 432, the pivoting plate 402 may be pivoted relative to the rear plate 410 about pivot axle 452. This pivoting action is shown in FIGS. 12 and 13 without ring 404 to block the view of the relative position of the bearings 406, 408. The pivoting action is also shown in FIG. 14 with the pivoting plate removed to show the relative position of the bearings 406, 408 when the sheave assembly is in an "open" position.

Further, as shown in FIG. 9, when the pivoting plate 402 is pivoted about the pivot axle 452, the ring 404 becomes exposed to the user. Such "opening" of the sheave assembly 400 allows the user to load the wireline or cable into the ring 404. Likewise, this type of opening of the sheave assembly 400 allows the wireline or cable to be readily removed from the ring 404 when the task is completed.

It should also be noted that, during use of the sheave assembly 400, the fact that the sheave assembly 400 of the present invention has multiple bearings 406, 408, 450 may provide significant advantages, including the redundancy discussed above in relation to failure of any one bearing.

The foregoing discussion and figures have focused on embodiments which utilize rollers or bearings to support the ring. It is within the scope of the invention to replace the rollers or bearings with a curved shoe assembly which is sized and configured to support the inner surface of the ring. The ring sheave can be simplified by eliminating the bearings or rollers and their accompanying axles and roller bearing assemblies. Moreover, the weight of the ring sheave may be significantly reduced by eliminating the rollers, axles, and bearing assemblies. A suitable curved shoe is prepared from a low friction material, such as polished aluminum or stainless steel, which may be further coated with a low friction coating, such as Teflon. The shoe may be attached to the front and rear plates in a manner similar to the embodiments discussed above. The shoe has a profile that is complementary to the profile of the inner surface of the ring.

In addition to the weight advantages mentioned above, eliminating the moving parts associated with the rollers provides a significant maintenance and cost advantage for the ring sheave. Moreover, the front and rear plates need not be spaced as far apart, which enables the sheave assembly to be assembled in a more compact form and further reduces the weight of the ring sheave assembly.

It will be appreciated by those of ordinary skill in the art that the ring sheave assembly disclosed herein is not limited to just wireline applications in the oil and gas well industries, but may be used in other fields where large and heavy sheave wheels are required, such as the stringing of power line cables.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

The invention claimed is:

1. A sheave assembly comprising:

a ring made of lubricated plastic, the ring being supported by a support assembly having a support surface, wherein the support surface is disposed in a generally semi-circular configuration, wherein the ring has an inner surface having a cross-sectional profile that is complementary to the support surface, and wherein the ring comprises a groove on an outer surface thereof; and a frame which supports the support assembly and which comprises pivoting means for opening and closing the sheave assembly to permit loading and unloading of a wireline or cable.

2. The sheave assembly according to claim 1, wherein the support assembly comprises a plurality of rollers.

3. The sheave assembly according to claim 1, wherein the support assembly comprises a plurality of bearings.

4. The sheave assembly according to claim 3, wherein the curved shoe is fabricated of polished metal.

5. The sheave assembly according to claim 1, wherein the support assembly comprises a curved shoe.

6. The sheave assembly according to claim 1, wherein the ring has a sheave diameter of at least of at least 16 inches.

7. The sheave assembly according to claim 1, wherein the pivoting means comprises a pivoting plate structure.

8. The sheave assembly according to claim 1, wherein the pivoting means comprises a pivoting gate structure.

9. A sheave assembly for operation with a wireline, comprising:

a support structure;

a pivot plate having a slot;

at least two rollers connected to the pivot plate, wherein the rollers comprise:

an outer surface; and an axle about which the outer surface rotates and which defines an axis of rotation for the rollers, wherein at least one of the rollers is a support roller, the support roller configured such that the axle of the support roller has a first end that engages the slot, and wherein one of the rollers is a pivot roller, the pivot roller configured such that the axle of the pivot roller functions as a pivot such that the plate may pivot about the axle of the pivot roller; and a ring made of lubricated plastic, the ring being supported by the outer surface of the rollers, wherein the ring comprises:

a groove for retaining the wireline;

an inner surface for mating with the outer surface of the rollers.

10. The sheave assembly of claim 9 wherein the plate further comprises a latch having an engaged position and a disengaged position, the latch designed such that when the latch is engaged, the latch prevents the plate from pivoting about the axle of the pivot roller.

11. The sheave assembly of claim 9 wherein the ring has a sheave diameter of at least of at least 16 inches.

12. The sheave assembly of claim 11 further comprising a securing pin that is attached to the second plate, the securing pin being designed to ensure engagement between the inner surface of the ring and the outer surface of the support roller.

13. The sheave assembly of claim 9 further comprising:

one or more additional support rollers; and one or more additional slots that correspond to the additional support rollers, wherein each of the additional support rollers comprise an axle having a first end that engages one of the additional slots.

14. A sheave assembly as in claim 9 wherein the slot has a generally arcuate shape.

15. A sheave assembly as in claim 9 wherein the axle of the support roller will engage into the slot in the plate.

16. A sheave assembly as in claim 9 wherein rollers further comprise bearings that operate to facilitate rotation of the rollers.

17. A sheave assembly as in claim 9 wherein the slot in the plate is not visible from an exterior surface of the plate.

18. A sheave assembly as in claim 9 further comprising a handguard assembly that prevents the user's hands, clothing, or body parts from being drawn into the sheave assembly.

19. A sheave assembly comprising:

a ring made of lubricated plastic, the ring being supported by a support assembly having a support surface comprising a plurality of bearings positioned in generally semi-circular configuration, wherein the ring has an inner surface having a cross-sectional profile that is complementary to the support surface, and wherein the ring comprises a groove on an outer surface thereof to accommodate a wireline or cable; and a frame which supports the support assembly and which comprises pivoting means for opening and closing the sheave assembly to permit loading and unloading of the wireline or cable.

20. The sheave assembly according to claim 19, wherein the pivoting means comprises a pivoting plate structure.

21. The sheave assembly according to claim 19, wherein the pivoting means comprises a pivoting gate structure.

22. The sheave assembly according to claim 19, wherein the ring has a sheave diameter of at least of at least 16 inches.

23. The sheave assembly according to claim 19, wherein the plurality of bearings are supported by a pair of parallel plates.

24. The sheave assembly according to claim 23, wherein the bearings are provided in pairs and disposed on each of the pair of plates to be aligned with each other.

25. The sheave assembly according to claim 23, wherein the bearings are provided in pairs and disposed on each of the pair of plates in a staggered arrangement such that the bearings are not aligned.

* * * * *